US011643710B2

(12) United States Patent
Shimamoto et al.

(10) Patent No.: US 11,643,710 B2
(45) Date of Patent: May 9, 2023

(54) MIXED POWDER FOR POWDER METALLURGY

(71) Applicant: JFE STEEL CORPORATION, Tokyo (JP)

(72) Inventors: Hanako Shimamoto, Tokyo (JP); Shigeru Unami, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 69 days.

(21) Appl. No.: 16/965,299

(22) PCT Filed: Dec. 12, 2018

(86) PCT No.: PCT/JP2018/045746
§ 371 (c)(1),
(2) Date: Jul. 28, 2020

(87) PCT Pub. No.: WO2019/163263
PCT Pub. Date: Aug. 29, 2019

(65) Prior Publication Data

US 2021/0114093 A1 Apr. 22, 2021

(30) Foreign Application Priority Data

Feb. 21, 2018 (JP) ..... JP2018-028886

(51) Int. Cl.

| | |
|---|---|
| ***B22F 1/02*** | (2006.01) |
| ***C10M 105/60*** | (2006.01) |
| ***C22C 33/02*** | (2006.01) |
| ***B22F 1/16*** | (2022.01) |
| ***B22F 1/103*** | (2022.01) |
| ***B22F 1/102*** | (2022.01) |

(52) U.S. Cl.
CPC ..... *C22C 33/02* (2013.01); *B22F 1/102* (2022.01); *B22F 1/103* (2022.01); *B22F 1/16* (2022.01); *C10M 105/60* (2013.01); *B22F 2301/35* (2013.01); *B22F 2302/40* (2013.01)

(58) Field of Classification Search
CPC .. B22F 1/16; B22F 1/102; B22F 1/103; B22F 2301/35; B22F 2302/40; B22F 2998/10; C10M 105/60; C22C 33/02
See application file for complete search history.

(56) References Cited

U.S. PATENT DOCUMENTS

| | | | | |
|---|---|---|---|---|
| 5,432,224 | A | 7/1995 | Ryuhgoh et al. | |
| 5,480,469 | A | 1/1996 | Storstrom et al. | |
| 5,648,160 | A * | 7/1997 | Kishimoto ..... | G06K 19/02 428/404 |
| 6,436,166 | B2 | 8/2002 | Arvidsson et al. | |
| 7,789,934 | B2 | 9/2010 | Suzuki et al. | |
| 9,352,393 | B2 | 5/2016 | Ono et al. | |
| 2006/0000310 | A1 | 1/2006 | Solimnjad | |
| 2010/0310406 | A1 | 12/2010 | Fujiura et al. | |
| 2015/0314372 | A1* | 11/2015 | Ono ..... | B22F 1/05 428/403 |

FOREIGN PATENT DOCUMENTS

| | | | | |
|---|---|---|---|---|
| CN | 101920335 | A | | 12/2010 |
| CN | 104388154 | A | * | 3/2015 |
| CN | 104388154 | A | | 3/2015 |
| CN | 104870125 | A | | 8/2015 |
| JP | H01212271 | A | * | 2/1988 |
| JP | H-01212271 | A | * | 8/1989 |
| JP | H01212271 | A | | 8/1989 |
| JP | H0230701 | A | | 2/1990 |
| JP | H06506726 | A | | 7/1994 |
| JP | H1167514 | A | | 3/1999 |
| JP | 2003508635 | A | | 3/2003 |
| JP | 2009180376 | A | | 8/2009 |
| JP | 2010280990 | A | | 12/2010 |
| WO | 2005068588 | A1 | | 7/2005 |
| WO | 2014103287 | A1 | | 7/2014 |

OTHER PUBLICATIONS

Jan. 6, 2022, Office Action issued by the China National Intellectual Property Administration in the corresponding Chinese Patent Application No. 201880089795.4 with English language search report.
Aug. 6, 2021, Office Action issued by the Canadian Intellectual Property Office in the corresponding Canadian Patent Application No. 3,090,455.
Feb. 2, 2021, the Extended European Search Report issued by the European Patent Office in the corresponding European Patent Application No. 18907048.5.
Jan. 7, 2020, Notification of Reasons for Refusal issued by the Japan Patent Office in the corresponding Japanese Patent Application No. 2019-518337 with English language Concise Statement of Relevance.

(Continued)

*Primary Examiner* — Humera N. Sheikh
*Assistant Examiner* — Kevin C T Li
(74) *Attorney, Agent, or Firm* — Kenja IP Law PC

(57) ABSTRACT

Provided is a mixed powder for powder metallurgy that contains a readily available compound as a lubricant, does not need to contain a stain-causing metal soap, has excellent ejection properties, and can exhibit excellent fluidity without deteriorating the ejection properties even in the case of further containing carbon black. The mixed powder for powder metallurgy contains (a) an iron-based powder and (b) a lubricant, where the lubricant (b) contains a specific aliphatic amine.

8 Claims, No Drawings

(56) References Cited

OTHER PUBLICATIONS

Mar. 12, 2019, International Search Report issued in the International Patent Application No. PCT/JP2018/045746.
May 31, 2022, Office Action issued by the China National Intellectual Property Administration in the corresponding Chinese Patent Application No. 201880089795.4 with English language concise statement of relevance.

* cited by examiner

MIXED POWDER FOR POWDER METALLURGY

TECHNICAL FIELD

This disclosure relates to a mixed powder for powder metallurgy, and particularly to a mixed powder for powder metallurgy that does not need to use a stain-causing metal soap, has excellent ejection properties, and can achieve both excellent fluidity and excellent ejection properties in the case of further using carbon black.

BACKGROUND

Powder metallurgy technology is a method with which parts having complex shapes can be formed in a shape that is extremely close to the shape of a product and can be produced with high dimensional accuracy. The powder metallurgy technique can significantly reduce cutting costs. Therefore, powder metallurgical products are widely used as all kinds of machines and parts.

In powder metallurgy, a mixed powder (hereinafter referred to as "mixed powder for powder metallurgy" or simply "mixed powder") is used, where the mixed powder is obtained by mixing an iron-based powder, which is a main raw material, with, if necessary, an alloying powder such as copper powder, graphite powder and iron phosphide powder, a powder for improving machinability such as MnS, and a lubricant.

The lubricant contained in the mixed powder for powder metallurgy plays an extremely important role when such a mixed powder for powder metallurgy is subjected to forming to produce a product. The effects of the lubricant will be described below.

First, the lubricant has a lubrication effect when the mixed powder is subjected to forming in a die. The effect is further roughly divided into the following two. One is the effect of reducing the friction between particles contained in the mixed powder. During the forming, the lubricant enters between the particles to reduce the friction, thereby promoting the rearrangement of the particles. The other is the effect of reducing the friction between the die used for forming and the particles. During the forming, the lubricant enters between the die and the particles, thereby reducing the friction between the die and the particles. With these two effects, the mixed powder can be compressed to a high density during the forming.

In addition, the lubricant also has a lubrication effect when the mixed powder (green compact) compacted in the die is taken (ejected) out of the die. Generally, a green compact is ejected out of a die by pushing it out with a punch, where large frictional resistance is generated due to the friction between the green compact and the surface of the die. In this case, some of the lubricant contained in the mixed powder that is in contact with the surface of the die reduces the frictional force.

As described above, the lubricant contained in the mixed powder for powder metallurgy plays a very important role in producing a product. However, the lubricant is only required during the forming and the ejection out of the die and is unnecessary in the subsequent processes. In addition, it is desirable that the lubricant disappears during the sintering of the green compact, so that no lubricant remains in a final sintered body.

In addition, since the lubricant generally has a stronger adhesive power than the iron-based powder, it deteriorates the fluidity of the mixed powder. Further, since the lubricant has a smaller specific gravity than the iron-based powder, the density of the green compact is lowered when a large amount of lubricant is contained in the mixed powder.

Furthermore, the lubricant used in the mixed powder for powder metallurgy is required to function as a binder in some cases. The binder here refers to a component that allows an alloying powder and other additive components to adhere to the surface of the iron-based powder which is a main component. A common mixed powder for powder metallurgy is obtained by simply mixing an iron-based powder with additive components such as an alloying powder, a powder for improving machinability, and a lubricant. However, each component may segregate inside the mixed powder in this state. Particularly for graphite powder, which is generally used as an alloying powder, it tends to segregate by flowing or vibrating the mixed powder because it has a smaller specific gravity than other components. In order to prevent such segregation, it has been proposed that the additive components be adhered to the surface of the iron-based powder via a binder. Such a powder is one kind of mixed powder for powder metallurgy and is also referred to as a segregation prevention treatment powder. The segregation prevention treatment powder has the additive components adhered to the iron-based powder, which prevents the above-described component segregation.

The binder used in such a segregation prevention treatment powder usually is a compound that also functions as a lubricant. This is because, by using a binder having lubricating ability, the total amount of the binder and the lubricant added to the mixed powder can be reduced.

Generally, such a mixed powder for powder metallurgy is subjected to press forming at a pressure of 300 MPa to 1000 MPa to obtain a predetermined part shape, and then is sintered at a high temperature of 1000° C. or higher to obtain a final part shape. The total amount of the lubricant and the binder contained in the mixed powder is generally about 0.1 parts by mass to 2 parts by mass with respect to 100 parts by mass of the iron-based powder. In order to increase the green density, the addition amount of the lubricant and the binder is preferably small. Therefore, the lubricant is required to exhibit excellent lubricating ability at a small mix proportion.

Conventionally, metal soaps such as zinc stearate are widely used as the lubricant. However, metal soaps cause stains on furnaces, workpieces and surfaces of sintered bodies during the sintering of a green compact. For this reason, various lubricants have been proposed to replace the metal soap.

For example, JP H06-506726 A (PTL 1) proposes using diamide wax as a lubricant as well as a binder. In addition, WO 2005/068588 A (PTL 2) proposes using polyhydroxycarboxylic acid amide as a lubricant.

Further, in order to improve the fluidity of the mixed powder for powder metallurgy containing a lubricant, it has been proposed that the mixed powder for powder metallurgy be further added with a powder for improving fluidity.

For example, JP 2003-508635 A (PTL 3) proposes adding a fluidity improving agent such as silica to a mixed powder containing a lubricant such as diamide wax, which also serves as a binder, to improve the fluidity. In addition, JP 2010-280990 A (PTL 4) proposes adding carbon black to a mixed powder containing a lubricant such as diamide wax, which also serves as a binder, to improve the fluidity and the apparent density.

CITATION LIST

Patent Literature

PTL 1: JP H06-506726 A
PTL 2: WO 2005/068588 A
PTL 3: JP 2003-508635 A
PTL 4: JP 2010-280990 A

SUMMARY

Technical Problem

However, the polyhydroxycarboxylic acid amide proposed in PTL 2 must be synthesized by an amidation reaction using polyhydroxycarboxylic acid or its equivalent and an aliphatic amine as raw materials, which is not readily available.

In addition, although the diamide wax used as a lubricant in PTL 1 and other documents has better ejection properties than metal soaps, there has been a demand for further improvement in ejection properties.

Further, when particles such as silica or carbon black are added to a conventional lubricant to improve the fluidity, as proposed in PTL 3 and PTL 4, the compressibility of the mixed powder is lowered. When the compressibility lowers, spring back increases during the forming, and ejection properties deteriorate.

It could thus be helpful to provide a mixed powder for powder metallurgy that contains a readily available compound as a lubricant, does not need to contain a stain-causing metal soap, has excellent ejection properties, and can exhibit excellent fluidity without deteriorating the ejection properties even in the case of further containing carbon black.

Solution to Problem

As a result of intensive study, we found that the problem can be solved when a specific aliphatic amine, which is readily available as a commercial product, is used as a lubricant. The present disclosure is based on the findings, and the primary features thereof are as follows.

1. A mixed powder for powder metallurgy comprising (a) an iron-based powder and (b) a lubricant, wherein the lubricant (b) comprises at least one aliphatic amine represented by the formula (1) or (2),

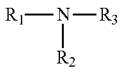

(1)

wherein $R_1$ is an alkyl group having 12 or more carbon atoms or an alkenyl group having 12 or more carbon atoms, and $R_2$ and $R_3$ are each independently a hydrogen atom, an alkyl group having 1 or more carbon atoms, or an alkenyl group having 2 or more carbon atoms; and

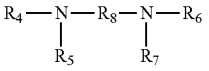

(2)

wherein $R_4$ is an alkyl group having 12 or more carbon atoms or an alkenyl group having 12 or more carbon atoms, $R_5$, $R_6$ and $R_7$ are each independently a hydrogen atom, an alkyl group having 1 or more carbon atoms, or an alkenyl group having 2 or more carbon atoms, and $R_8$ is an alkylene group having 1 to 5 carbon atoms.

2. The mixed powder for powder metallurgy according to 1., wherein the aliphatic amine has a melting point of 20° C. or higher.

3. The mixed powder for powder metallurgy according to 2., wherein the aliphatic amine has a melting point of 40° C. or higher.

4. The mixed powder for powder metallurgy according to any one of 1. to 3., wherein the aliphatic amine is a primary amine or a secondary amine.

5. The mixed powder for powder metallurgy according to any one of 1. to 4., comprising one or both of (c) an alloying powder and (d) a powder for improving machinability.

6. The mixed powder for powder metallurgy according to 5., wherein one or both of the alloying powder (c) and the powder for improving machinability (d) are adhered to a surface of the iron-based powder (a) via (e) a binder.

7. The mixed powder for powder metallurgy according to 6., wherein at least a part of the lubricant (b) also serves as the binder (e).

8. The mixed powder for powder metallurgy according to 7., wherein the aliphatic amine contained in the lubricant (b) also serves as the binder (e).

9. The mixed powder for powder metallurgy according to any one of 1. to 8., comprising (f) carbon black.

10. The mixed powder for powder metallurgy according to 9., wherein the carbon black (f) is 0.06 parts by mass to 3.0 parts by mass with respect to 100 parts by mass of the iron-based powder (a).

11. A sintered body using the mixed powder for powder metallurgy according to any one of 1. to 10.

Advantageous Effect

The mixed powder for powder metallurgy of the present disclosure can exhibit extremely excellent ejection properties without containing any stain-causing metal soap. In addition, the mixed powder for powder metallurgy can exhibit excellent fluidity without deteriorating the ejection properties even in the case where hard fine particles such as carbon black are added to improve the fluidity. Further, the aliphatic amine used as a lubricant in the present disclosure is readily available as a commercial product, which is advantageous in terms of production and cost.

DETAILED DESCRIPTION

The following describes the present disclosure in detail, yet the description is exemplification and does not limit the scope of the present disclosure.

The mixed powder for powder metallurgy of the present disclosure contains the following (a) and (b) as essential components. The mixed powder for powder metallurgy of the present disclosure can contain at least one selected from the following (c) to (f), in addition to the following (a) and (b). Further, the mixed powder for powder metallurgy of the present disclosure can contain components other than the following (a) to (f), in a range where the effects of the present disclosure are not impaired. Each component will be described below.

(a) Iron-based powder
(b) Lubricant
(c) Alloying powder
(d) Powder for improving machinability
(e) Binder
(f) Carbon black (a) Iron-Based Powder In the present specification, the iron-based powder refers to a metal powder containing 50 mass % or more of Fe. The iron-based powder is not particularly limited, and examples thereof include an iron powder and a ferroalloy powder. In the present specification, the iron powder (commonly referred to in the art as "pure iron powder") refers to a powder consisting of Fe and inevitable impurities. The ferroalloy powder is not particularly limited if it is an alloy powder containing 50 mass % or more of Fe, and the ferroalloy powder includes an alloyed steel powder. The alloyed steel powder is not particularly limited, and examples thereof include a pre-alloyed steel powder (fully alloyed steel powder) where an alloying element is pre-alloyed during smelting, a partially diffused alloyed steel powder where an alloying element is partially diffused in an iron powder and alloyed, and a hybrid steel powder where an alloying element is further partially diffused in a pre-alloyed steel powder. The alloying element is not particularly limited, and examples thereof include C, Cu, Ni, Mo, Mn, Cr, V, and Si. The alloying element may contain one or more kinds of alloying elements.

The method of producing the iron-based powder is not particularly limited. Examples include a reduced iron-based powder produced by reducing iron oxide, and an atomized iron-based powder produced with an atomizing method. Although the average particle size of the iron-based powder is not particularly limited, it is preferably 30 μm or more and more preferably 60 μm or more and is preferably 120 μm or less and more preferably 100 μm or less. In the present specification, unless otherwise specified, the average particle size refers to a median size (D50) measured with a laser diffraction particle size distribution measuring device.

Although the ratio of the mass of the iron-based powder to the total mass of the mixed powder for powder metallurgy is not particularly limited, it is preferably 85 mass % or more and more preferably 90 mass % or more.

(b) Lubricant

[Aliphatic Amine]

In the present disclosure, it is important to use an aliphatic amine represented by the following general formula (1) or (2) as the lubricant. The aliphatic amine may contain one or more kinds of aliphatic amines.

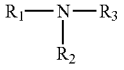

(1)

(In the formula, $R_1$ is an alkyl group having 12 or more carbon atoms or an alkenyl group having 12 or more carbon atoms, and $R_1$ is preferably an alkyl group having 12 or more carbon atoms; and $R_2$ and $R_3$ are each independently a hydrogen atom or an alkyl group having 1 or more carbon atoms or an alkenyl group having 2 or more carbon atoms, and it is preferable that both $R_2$ and $R_3$ are hydrogen atoms, or one of $R_2$ and $R_3$ is a hydrogen atom and the other is an alkyl group having 12 or more carbon atoms.)

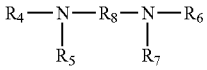

(2)

(In the formula, $R_4$ is an alkyl group having 12 or more carbon atoms or an alkenyl group having 12 or more carbon atoms, and $R_4$ is preferably an alkyl group having 12 or more carbon atoms;

$R_5$, $R_6$ and $R_7$ are each independently a hydrogen atom or an alkyl group having 1 or more carbon atoms or an alkenyl group having 2 or more carbon atoms, and it is preferable that all of $R_6$, $R_5$ and $R_7$ are hydrogen atoms, or $R_5$ and $R_7$ each independently are a hydrogen atom or an alkyl group having 1 or more carbon atoms or an alkenyl group having 2 or more carbon atoms, and $R_6$ is an alkyl group having 12 or more carbon atoms or an alkenyl group having 12 or more carbon atoms; and $R_8$ is an alkylene group having 1 to 5 carbon atoms, and $R_8$ is preferably an alkylene group having 1 to 3 carbon atoms.)

By using the aliphatic amine as the lubricant, it is possible to obtain excellent ejection properties without containing any metal soap. In addition, when it is used in combination with carbon black as described later, it is possible to suppress a decrease in ejection properties caused by carbon black. Further, the aliphatic amine is advantageous in that it is readily available as a commercial product.

In the present specification, the alkyl group, alkenyl group or alkylene group can be either linear or branched unless otherwise specified.

The alkyl group having 12 or more carbon atoms or the alkenyl group having 12 or more carbon atoms in the formulas (1) and (2) is preferably linear. Although the upper limit of the number of carbon atoms is not particularly limited, it is preferably 30 or less and more preferably 25 or less from the viewpoint of availability of the aliphatic amine.

In addition, the alkyl group having 1 or more carbon atoms or the alkenyl group having 2 or more carbon atoms in the formulas (1) and (2) is preferably linear. Although the upper limit of the number of carbon atoms is not particularly limited, it is preferably 30 or less and more preferably 25 or less from the viewpoint of availability of the aliphatic amine.

The aliphatic amine preferably has a melting point of 20° C. or higher. This is because, when the melting point of the aliphatic amine is 20° C. or higher, it is easy to obtain a lubricant in a solid state at 20° C. around normal temperature, and it is possible to sufficiently prevent the deterioration of the fluidity of the mixed powder and to increase the mix proportion of the lubricant. The melting point of the aliphatic amine is more preferably 25° C. or higher, still more preferably 30° C. or higher, and particularly preferably 40° C. or higher. The melting point of the aliphatic amine is preferably 100° C. or lower and more preferably 85° C. or lower from the viewpoint of handleability.

Particular in the case where a powdered lubricant is mixed with the iron-based powder, the melting point of the aliphatic amine is preferably 40° C. or higher. This is because even when these powders are mixed at a temperature around normal temperature, the temperature inside a mixer may be around 40° C. due to frictional heat. By using an aliphatic amine having a melting point of 40° C. or higher as the lubricant, it is possible to sufficiently prevent the occurrence of agglomerates during the mixing.

The aliphatic amine is preferably a primary or secondary amine. A primary or secondary amine has a hydrogen atom(s) directly bonded to a nitrogen atom. Therefore, the interaction between the aliphatic amine and the iron-based powder or a surface of a die is greater than that of a tertiary amine having no hydrogen atom directly bonded to a nitrogen atom, and the aliphatic amine can be expected to exhibit excellent performance as a lubricant.

Although the aliphatic amine may be any compound represented by the formula (1) or (2), the following compounds are preferred.

An aliphatic amine where, in the formula (1), $R_1$ is a linear alkyl group having 15 to 25 carbon atoms, and both $R_2$ and $R_3$ are hydrogen atoms or linear alkyl groups each having 1 to 4 carbon atoms An aliphatic amine where, in the formula (1), $R_1$ is a linear alkyl group having 15 to 25 carbon atoms, and one of $R_2$ and $R_3$ is a hydrogen atom and the other is a linear alkyl group having 15 to 25 carbon atoms (it is more preferable that $R_1$ is the same as $R_2$ or $R_3$ which is a linear alkyl group having 15 to 25 carbon atoms)

An aliphatic amine where, in the formula (2), $R_4$ is a linear alkyl group having 15 to 25 carbon atoms, all of $R_5$ to $R_7$ are hydrogen atoms, and $R_8$ is a linear or branched alkylene group having 2 to 4 carbon atoms Examples of the aliphatic amine include the following compounds.

Stearylamine ($C_{18}H_{37}$—$NH_2$)

Behenylamine ($C_{22}H_{45}$—$NH_2$)

Distearylamine [$(C_{18}H_{37})_2$—NH]

Cetylamine ($C_{16}H_{33}$—$NH_2$)

Dimethyl behenylamine [$C_{22}H_{45}$—N—$(CH_3)_2$)]

Behenyl propylenediamine ($C_{22}H_{45}$—NH—$C_3H_6$—$NH_2$)

[Other Lubricants]

The mixed powder for powder metallurgy of the present disclosure may contain only the above-described aliphatic amine as the lubricant and may use other lubricants as well. The other lubricants are not particularly limited, and examples thereof include amide compounds such as fatty acid monoamide, fatty acid bisamide, and amide oligomers; high molecular compounds such as polyamide, polyethylene, polyester, polyol, and saccharides; and metal soaps such as zinc stearate and calcium stearate. However, as described above, metal soaps cause stains on furnaces, workpieces and surfaces of sintered bodies. Therefore, it is preferable that the mixed powder for powder metallurgy does not contain any metal soap.

[Amount and Form of Lubricant]

The mass of the lubricant is preferably 0.1 parts by mass or more and more preferably 0.2 parts by mass or more and is preferably 2.0 parts by mass or less and more preferably 1.8 parts by mass or less with respect to 100 parts by mass of the iron-based powder.

The mass ratios of the aliphatic amine and the other lubricants in the mass of the lubricant is not particularly limited. However, from the viewpoint of sufficiently exhibiting the excellent properties of the aliphatic amine, it is desirable that the mass ratio of the other lubricants is low. Specifically, the mass ratio of the aliphatic amine in the mass of the lubricant is preferably 50 mass % or more. For example, it may be 55 mass % or more. The upper limit of the mass ratio of the aliphatic amine is not particularly limited, and it may be 100 mass %.

The mass of the aliphatic amine is preferably 0.1 parts by mass or more and more preferably 0.2 parts by mass or more and is preferably 1.0 part by mass or less and more preferably 0.9 parts by mass or less with respect to 100 parts by mass of the iron-based powder.

The lubricant may be in the form of a powder or may be a composite powder adhered to other components. The powder and the composite powder may be used in combination.

In the case where the lubricant is in the form of a powder, the average particle size (median size (D50)) is preferably 1 μm or more and more preferably 5 μm or more and is preferably 100 μm or less and more preferably 50 μm or less.

In the case where the lubricant is a composite powder adhered to other components, it may be a powder where the lubricant is adhered to the iron-based powder, and this form includes a powder where the iron-based powder is coated with the lubricant.

In the case where the mixed powder for powder metallurgy of the present disclosure contains one or both of the alloying powder and the powder for improving machinability described later, these powders can be adhered to the iron-based powder by the lubricant which also serves as a binder. The lubricant which also serves as a binder may be the above-described aliphatic amine. From the viewpoint of the interaction of the iron-based powder, the alloying powder and the powder for improving machinability, it is preferably an aliphatic amine which is a primary or secondary amine. In addition, the amide compounds such as fatty acid monoamide, fatty acid bisamide and amide oligomers, the high molecular compounds such as polyamide, polyethylene, polyester, polyol and saccharides, and the like may also be used as the lubricant which also serves as a binder.

When the lubricant also serves as a binder, it is possible to reduce the total amount of the binder and the lubricant in the whole mixed powder. Therefore, it is preferable to use a lubricant which also serves as a binder. The lubricant may a lubricant at least a part of which also serves as a binder or may be a lubricant all of which also serves as a binder.

(c) Alloying Powder and (d) Powder for Improving Machinability

The mixed powder for powder metallurgy of the present disclosure can contain one or both of (c) an alloying powder and (d) a powder for improving machinability. The alloying powder (c) and the powder for improving machinability (d) are optional components, and the mass of each and the total mass may be, for example, 0 parts by mass with respect to 100 parts by mass of the iron-based powder.

The alloying powder refers to a powder where, when the mixed powder is sintered, the alloying element in the alloying powder dissolves in iron and alloys. By using the alloying powder, it is possible to improve the strength of a final sintered body. When using the alloying powder, the alloying powder may contain one or more kinds of alloying powders.

The alloying element is not particularly limited, and examples thereof include C, Cu, Ni, Mo, Mn, Cr, V, and Si. The alloying powder may be a metal powder composed of one kind of alloying element or may be an alloy powder composed of two or more kinds of alloying elements. An alloy powder composed of Fe and one or more kinds of alloying elements, where the Fe content is less than 50 mass %, can also be used. When C is used as an alloy component, it is preferable to use graphite powder as the alloying powder. The alloying powder is preferably Cu powder or graphite powder.

The powder for improving machinability is a component for improving the machinability (workability) of a sintered body obtained by sintering the mixed powder, and examples thereof include MnS, $CaF_2$ and talc. When using the powder for improving machinability, the powder for improving machinability may contain one or more kinds of powders for improving machinability.

The mass of one or both of the alloying powder (c) and the powder for improving machinability (d) is preferably 10 parts by mass or less, more preferably 7 parts by mass or less, and still more preferably 5 parts by mass or less with respect to 100 parts by mass of the iron-based powder. When the mass of one or both of the alloying powder (c) and the powder for improving machinability (d) is set within the above ranges, it is possible to further increase the density of the sintered body and further improve the strength of the sintered body. On the other hand, the mass of these components is preferably 0.1 parts by mass or more, more preferably 0.5 parts by mass or more, and still more preferably 1 part by mass or more. When the total mass of the alloying powder (c) and the powder for improving machinability (d) is set within the above ranges, it is possible to further enhance the effects of adding these components.

The average particle size of the alloying powder (c) and the powder for improving machinability (d) is not particularly limited. However, it is preferably 0.1 μm or more and more preferably 1 μm or more and is preferably 100 μm or less and more preferably 50 μm or less.

(e) Binder

When the mixed powder for powder metallurgy of the present disclosure contains at least one of the alloying powder and the powder for improving machinability, it is preferable to use a binder to prevent segregation. The binder allows one or both of the alloying powder and the powder for improving machinability to adhere to the surface of the iron-based powder, thereby preventing segregation and further improving the properties of the sintered body. That is, the mixed powder for powder metallurgy can be used as a segregation prevention treatment powder.

The binder is not particularly limited and may be anything that allows one or both of the alloying powder and the powder for improving machinability to adhere to the surface of the iron-based powder. As described above, the lubricant can also serve as a binder.

When the mass of one or both of the alloying powder and the powder for improving machinability is 100 parts by mass, the mass of the binder is preferably 5 parts by mass or more and more preferably 10 parts by mass or more from the viewpoint of adhesion, and is preferably 50 parts by mass or less and more preferably 40 parts by mass or less from the viewpoint of the density of the sintered body. When the lubricant also serves as a binder, the mass of the binder also includes the mass of the lubricant which also serves as a binder. By using such a lubricant, it is possible to reduce the total amount of the binder and the lubricant in the whole mixed powder. Conversely, it is preferable to use a binder that has lubricating ability and can function as a lubricant. In this case, the binder can also serve as a lubricant. The binder may contain a lubricant which also serves as a binder as well as other binders.

(f) Carbon Black

The mixed powder of the present disclosure can contain carbon black as a powder for improving fluidity, in order to further improve the fluidity. When the mixed powder contains one or both of the alloying powder (c) and the powder for improving machinability (d), it is preferable to blend carbon black.

Although the specific surface area of the carbon black is not particularly limited, it is preferably 50 $m^2/g$ or more and 120 $m^2/g$ or less. The specific surface area here is a value measured with the BET method. In addition, although the average particle size of the carbon black is not particularly limited, it is preferably 5 nm or more and 500 nm or less. The average particle size of the carbon black here is the arithmetic average of the particle sizes of the particles observed with an electron microscope.

In the case of using carbon black, the addition amount of the carbon black may be 0.06 parts by mass to 3.0 parts by mass with respect to 100 parts by mass of the iron-based powder. When the content of the carbon black is 0.06 parts by mass or more, it is easy to obtain a sufficient fluidity improving effect. On the other hand, when the addition amount of the carbon black is 3.0 parts by mass or less, it is possible to sufficiently prevent a decrease in compressibility and ejection properties due to the blending of carbon black.

[Production Method]

The method of producing the mixed powder for powder metallurgy of the present disclosure is not particularly limited. For example, the mixed powder for powder metallurgy may be obtained by mixing the above components using a mixer. The addition and mixing of each component may be performed at one time or may be performed at two or more times. The mixing is preferably performed at room temperature (20° C.).

In the case of using a binder, the above components may be stirred while being heated at a temperature equal to or higher than the melting point of the binder (for example, a temperature range that is 10° C. to 100° C. higher than the melting point), and gradually cooled while being mixed, for example Through the heating and stirring, the surface of the iron-based powder can be coated with the molten binder. In addition, the presence of the alloying powder and the powder for improving machinability during the heating and stirring allows these powders to adhere to the iron-based powder via the binder. In the case of using carbon black, the carbon black may be mixed after the alloying powder and the powder for improving machinability are adhered to the iron-based powder via the binder. In the above production method, the binder may be a binder that also serves as a lubricant.

The mixing means is not particularly limited and may use anything such as all kinds of known mixers. From the viewpoint of easy heating, it is preferable to use a high-speed bottom stirring mixer, an inclined rotating pan-type mixer, a rotating hoe-type mixer, and a conical planetary screw-type mixer.

[Sintered Body]

The mixed powder for powder metallurgy of the present disclosure can be used to obtain a sintered body. The method of producing the sintered body is not particularly limited. It may a method of filling the mixed powder for powder metallurgy of the present disclosure in a die, compacting the mixed powder to obtain a green compact, and then taking the green compact out and subjecting it to sintering treatment. The method of compacting is not particularly limited, and examples thereof include press forming. The pressure of the press forming may be, for example, 300 MPa to 1000 MPa.

The method of sintering treatment is not particularly limited. For example, the green compact may be sintered at a high temperature of 1000° C. or higher. The temperature of the sintering treatment is preferably 1300° C. or lower. The atmosphere of the sintering treatment is not particularly limited and may be an atmosphere of an inert gas such as nitrogen or argon.

The obtained sintered body can be subjected to a known post-treatment. For example, it may be made into a product having a predetermined size by cutting work or the like.

The mixed powder for powder metallurgy of the present disclosure is excellent in fluidity, so that it is advantageous in compacting. In addition, by using the mixed powder for metallurgy of the present disclosure, it is possible to eject a green compact out of a die with a low ejection force, which is advantageous.

EXAMPLES

Example 1

Mixed powders for powder metallurgy were prepared by the following procedure. The properties of the obtained mixed powder for powder metallurgy, and the properties of a green compact prepared with the mixed powder for powder metallurgy were evaluated.

First, (b) an alloying powder and (c) a lubricant were added to (a) an iron-based powder, and these components were heated and mixed at a temperature equal to or higher than the melting point of the lubricant and then cooled to room temperature (20° C.).

An iron powder (pure iron powder) (JIP301A manufactured by JFE Steel Corporation) prepared with an atomizing method was used as the iron-based powder (a). The median size D50 of the iron powder was 80 μm. The median size D50 was measured with a laser diffraction particle size distribution measuring device. The median sizes D50 of the following other powders, except carbon black, were measured in the same manner.

Components used as the lubricant (b) and the alloying powder (c) and the mix proportion of each component are listed in Table 1. The median size D50 of the lubricant used is as listed in Table 1. Copper powder and graphite powder were used as the alloying powder, where the median size D50 of the copper powder was 25 μm and the median size D50 of the graphite powder was 4.2 μm.

In the present example, the lubricant also serves as a binder. That is, the alloying powder adheres to the surface of the iron-based powder via the lubricant which also serves as a binder.

Next, the apparent density and the powder fluidity of each of the obtained mixed powder for powder metallurgy were evaluated by the following procedure. The measurement results are also listed in Table 1.

(Apparent Density)

The apparent density was evaluated using a funnel having a diameter of 2.5 mm according to the method specified in JIS Z 2504.

(Limit Outflow Diameter)

The powder fluidity was evaluated based on a limit outflow diameter. First, a container was prepared, where the container had a cylindrical shape with an inner diameter of 67 mm and a height of 33 mm and was provided with a discharge hole whose diameter could be changed at the bottom. With the discharge hole closed, the container was filled with the mixed powder at an amount of slightly overflowing from the container. After keeping this state for 5 minutes, the powder above the brim of the container was leveled off with a spatula along the brim of the container. Next, the discharge hole was gradually opened, and the minimum diameter at which the mixed powder could be discharged was measured. The minimum diameter was defined as the limit outflow diameter. The smaller the limit outflow diameter is, the better the fluidity is.

Further, a green compact was prepared using the mixed powder for powder metallurgy, and the density (green density) and the ejection force of the obtained green compact were evaluated. In the evaluation, a tablet-shaped green compact having a diameter of 11.3 mm×10 mm was prepared by subjecting the mixed powder to forming at a pressure of 686 MPa in accordance with JIS Z 2508 and JPMA P 10. The green density was calculated from the size and the weight of the obtained green compact. The ejection force was determined from the ejection load when the green compact was ejected out of the die. The measurement results are listed in Table 1.

As can be seen from the results listed in Table 1, the mixed powder for powder metallurgy satisfying the conditions of the present disclosure had a lower ejection force than that of Comparative Example and was excellent in ejection properties.

TABLE 1

| | Mixed powder for powder metallurgy | | | | | | | | |
|---|---|---|---|---|---|---|---|---|---|
| | Composition | | | | | | | | |
| | (a) | (b) Lubricant *1 | | | | (c) Alloying powder | | Properties | |
| No. | Iron-based powder (part by mass) | Type | Average particle size (μm) | Melting point (° C.) | Addition amount (part by mass) *2 | Copper powder (part by mass) *2 | Graphite powder (part by mass) *2 | Apparent density (g/cm$^3$) | Limit outflow diameter (mm) |
| 1 | 100 | Stearylamine | 28 | 53 | 0.8 | 2.0 | 0.8 | 3.38 | 32.5 |
| 2 | 100 | Behenylamine | 27 | 55-65 | 0.8 | 2.0 | 0.8 | 3.31 | 32.5 |
| 3 | 100 | Distearylamine | 30 | 65-70 | 0.8 | 2.0 | 0.8 | 3.38 | 32.5 |
| 4 | 100 | Dimethyl behenylamine | 28 | 44 | 0.8 | 2.0 | 0.8 | 3.3 | 32.5 |
| 5 | 100 | Behenyl propylenediamine | 35 | 61-68 | 0.8 | 2.0 | 0.8 | 3.4 | 35 |
| 6 | 100 | EBS *3 | 30 | 140-145 | 0.8 | 2.0 | 0.8 | 3.34 | 30 |
| 7 | 100 | Zinc stearate | 13 | 125 | 0.8 | 2.0 | 0.8 | 3.57 | 15 |
| 8 | 100 | Stearylamine | 28 | 53 | 0.8 | — | — | 3.11 | 32.5 |
| 9 | 100 | EBS *3 | 30 | 140-145 | 0.8 | — | — | 3.14 | 30 |

TABLE 1-continued

| No. | Conditions of heating and mixing in the production of mixed powder for powder metallurgy: Temperature (° C.) | Time (min) | Green compact Properties: Green density (g/cm³) | Ejection force (MPa) | Remarks |
|---|---|---|---|---|---|
| 1 | 140 | 20 | 7.10 | 13.6 | Example |
| 2 | 140 | 20 | 7.11 | 12.4 | Example |
| 3 | 140 | 20 | 7.11 | 11.6 | Example |
| 4 | 140 | 20 | 7.11 | 12.7 | Example |
| 5 | 140 | 20 | 7.13 | 13.4 | Example |
| 6 | 160 | 20 | 7.10 | 15.1 | Comparative Example |
| 7 | 140 | 20 | 7.15 | 18.4 | Comparative Example |
| 8 | 140 | 20 | 7.14 | 15.4 | Example |
| 9 | 160 | 20 | 7.13 | 18.1 | Comparative Example |

*1 In the present example, the lubricant also serves as a binder.
*2 Amount with respect to 100 parts by mass of iron-based powder
*3 N,N'-ethylene bisstearic acid amide

Example 2

In addition, mixed powders for powder metallurgy containing (f) carbon black were prepared, and they were evaluated in the same manner as in Example 1. The type and mix proportion of components used are listed in Table 2. The specific surface area of the carbon black used (according to the BET specific surface area measurement method) was 95 $m^2/g$ and the average particle size of the carbon black used (according to the arithmetic average of the particle sizes of the particles observed with an electron microscope) was 25 nm. The average particle size of the iron-based powder and the average particle sizes of the copper powder and the graphite powder used as the alloying powder are the same as in Example 1, and the average particle size of the lubricant is as listed in Table 2.

During the preparation of the mixed powder, first, (b) an alloying powder and (c) a lubricant were added to (a) an iron-based powder, and these components were heated and mixed at a temperature equal to or higher than the melting point of the lubricant and then cooled to room temperature (20° C.). Thereafter, (f) carbon black was added to the cooled powder and mixed to obtain a mixed powder for powder metallurgy. Other conditions were the same as those in Example 1. The evaluation results are listed in Table 2.

As can be seen from the results listed in Table 2, the ejection properties of the mixed powder of Comparative Example were deteriorated due to the addition of carbon black, yet the mixed powder for powder metallurgy satisfying the conditions of the present disclosure still had good ejection properties. Thus, the mixed powder for powder metallurgy of the present disclosure can achieve both excellent fluidity and excellent ejection properties in the case of using carbon black.

TABLE 2

| Mixed powder for powder metallurgy | | | | | | | | | | |
|---|---|---|---|---|---|---|---|---|---|---|
| | Composition | | | | | | | | | |
| | (a) | (b) Lubricant *1 | | | | (c) Alloying powder | | (f) | Properties | |
| No. | Iron-based powder (part by mass) | Type | Average particle size (μm) | Melting point (° C.) | Addition amount (part by mass) *2 | Copper powder (part by mass) *2 | Graphite powder (part by mass) *2 | Carbon black (part by mass) | Apparent density (g/cm³) | Limit outflow diameter (mm) |
| 1 | 100 | Stearylamine | 28 | 53 | 0.7 | 2.0 | 0.8 | 0.1 | 3.42 | 2.5 |
| 2 | 100 | Behenylamine | 27 | 55-65 | 0.7 | 2.0 | 0.8 | 0.1 | 3.36 | 2.5 |
| 3 | 100 | Distearylamine | 30 | 65-70 | 0.7 | 2.0 | 0.8 | 0.1 | 3.42 | 2.5 |
| 4 | 100 | Dimethyl behenylamine | 28 | 44 | 0.7 | 2.0 | 0.8 | 0.1 | 3.35 | 2.5 |
| 5 | 100 | Behenyl propylenediamine | 35 | 61-68 | 0.7 | 2.0 | 0.8 | 0.1 | 3.4 | 2.5 |
| 6 | 100 | EBS *3 | 30 | 140-145 | 0.7 | 2.0 | 0.8 | 0.1 | 3.39 | 2.5 |

TABLE 2-continued

| No. | Conditions of heating and mixing in the production of mixed powder for powder metallurgy: Temperature (° C.) | Time (min) | Green compact Properties: Green density (g/cm³) | Ejection force (MPa) | Remarks |
|---|---|---|---|---|---|
| 1 | 140 | 20 | 7.07 | 16.6 | Example |
| 2 | 140 | 20 | 7.08 | 15.4 | Example |
| 3 | 140 | 20 | 7.08 | 14.7 | Example |
| 4 | 140 | 20 | 7.08 | 15.4 | Example |
| 5 | 140 | 20 | 7.10 | 16.1 | Example |
| 6 | 160 | 20 | 7.07 | 18.1 | Comparative Example |

*1 In the present example, the lubricant also serves as a binder.
*2 Amount with respect to 100 parts by mass of iron-based powder
*3 N,N'-ethylene bisstearic acid amide

Example 3

In Examples 1 and 2, the mixed powders for powder metallurgy were prepared by heating and mixing the components at a temperature equal to or higher than the melting point of the lubricant. Therefore, in Examples 1 and 2, the lubricant also serves as a binder. However, the present disclosure is also effective in the case of using no binder, that is, in the case where the lubricant is simply mixed without being heated. The average particle size of the iron-based powder and the average particle size of the copper powder and the graphite powder used as the alloying powder are the same as that in Example 1, and the specific surface area and the average particle size of the carbon black are the same as that in Example 2. The average particle size of the lubricant is as listed in Table 3.

Then, (b) an alloying powder, (c) a lubricant and (f) carbon black were added to (a) an iron-based powder, and the components were mixed for 15 minutes at room temperature (20° C.) using a V-shaped blender to obtain a mixed powder for powder metallurgy. The type and mix proportion of components used, and the evaluation results are listed in Table 3.

As can be seen from the results listed in Table 3, the mixed powder of Example 3 had a lower ejection force than that of Comparative Example and was excellent in ejection properties. In addition, the ejection properties of the mixed powder of Comparative Example were deteriorated due to the addition of carbon black, yet the mixed powder for powder metallurgy satisfying the conditions of the present disclosure still had good ejection properties.

TABLE 3

| Mixed powder for powder metallurgy — Composition | | | | | | | | |
|---|---|---|---|---|---|---|---|---|
| | (a) | (b) Lubricant *1 | | | | (c) Alloying powder | | (f) |
| No. | Iron-based powder (part by mass) | Type | Average particle size (μm) | Melting point (° C.) | Addition amount (part by mass) *1 | Copper powder (part by mass) *1 | Graphite powder (part by mass) *1 | Carbon black (part by mass) |
| 1 | 100 | Stearylamine | 28 | 53 | 0.8 | 2.0 | 0.8 | — |
| 2 | 100 | Behenylamine | 27 | 55-65 | 0.8 | 2.0 | 0.8 | — |
| 3 | 100 | EBS *2 | 30 | 140-145 | 0.8 | 2.0 | 0.8 | — |
| 4 | 100 | Stearylamine | 28 | 53 | 0.7 | 2.0 | 0.7 | 0.1 |
| 5 | 100 | Behenylamine | 27 | 55-65 | 0.7 | 2.0 | 0.7 | 0.1 |
| 6 | 100 | EBS *2 | 30 | 140-145 | 0.7 | 2.0 | 0.7 | 0.1 |

| No. | Mixed powder for powder metallurgy Properties: Apparent density (g/cm³) | Limit outflow diameter (mm) | Green compact Properties: Green density (g/cm³) | Ejection force (MPa) | Remarks |
|---|---|---|---|---|---|
| 1 | 3.18 | 42.5 | 7.04 | 10.6 | Example |
| 2 | 3.11 | 42.5 | 7.05 | 9.4 | Example |
| 3 | 3.14 | 40 | 7.04 | 13.1 | Comparative Example |
| 4 | 3.22 | 2.5 | 6.99 | 10.6 | Example |

TABLE 3-continued

| | | | | | |
|---|---|---|---|---|---|
| 5 | 3.1 | 2.5 | 6.98 | 9.4 | Example |
| 6 | 3.22 | 2.5 | 7.01 | 15.1 | Comparative Example |

*1 Amount with respect to 100 parts by mass of iron-based powder

*2 N,N'-ethylene bisstearic acid amide

The invention claimed is:

1. A mixed powder for powder metallurgy comprising (a) an iron-based powder containing 50 mass % or more of Fe, (b) a lubricant, and one or both of (c) an alloying powder and (d) a powder for improving machinability, wherein the lubricant (b) comprises at least one aliphatic amine represented by the formula (1) or (2),

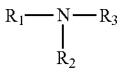

(1)

wherein $R_1$ is an alkyl group having 12 or more carbon atoms or an alkenyl group having 12 or more carbon atoms, and $R_2$ and $R_3$ are each independently a hydrogen atom, an alkyl group having 1 or more carbon atoms, or an alkenyl group having 2 or more carbon atoms; and

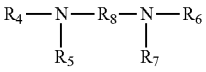

(2)

wherein $R_4$ is an alkyl group having 12 or more carbon atoms or an alkenyl group having 12 or more carbon atoms, $R_5$, $R_6$ and $R_7$ are each independently a hydrogen atom, an alkyl group having 1 or more carbon atoms, or an alkenyl group having 2 or more carbon atoms, and $R_8$ is an alkylene group having 1 to 5 carbon atoms, and wherein the aliphatic amine is a primary amine or a secondary amine, and wherein one or both of the alloying powder (c) and the powder for improving machinability (d) are adhered to a surface of the iron-based powder (a) via the at least one aliphatic amine represented by the formula (1) or (2).

2. The mixed powder for powder metallurgy according to claim 1, wherein the aliphatic amine has a melting point of 20° C. or higher.

3. The mixed powder for powder metallurgy according to claim 2, wherein the aliphatic amine has a melting point of 40° C. or higher.

4. The mixed powder for powder metallurgy claim 1, comprising (f) carbon black.

5. The mixed powder for powder metallurgy according to claim 4, wherein the carbon black (f) is 0.06 parts by mass to 3.0 parts by mass with respect to 100 parts by mass of the iron-based powder (a).

6. A sintered body using the mixed powder for powder metallurgy according to claim 1.

7. The mixed powder for powder metallurgy according to claim 1, wherein the alloying powder (c) has an average particle size of 0.1 μm or more and 100 μm or less, and the powder for improving machinability (d) has an average particle size of 0.1 μm or more and 100 μm or less.

8. The mixed powder for powder metallurgy according to claim 1, wherein the at least one aliphatic amine represented by the formula (1) or (2) serves as a binder.

* * * * *